US010283290B2

(12) United States Patent
Lydecker

(10) Patent No.: US 10,283,290 B2
(45) Date of Patent: May 7, 2019

(54) ROTARY SWITCH EMPLOYING KEYPAD OR SIMILAR MECHANISM FOR POSITION INDICATION

(71) Applicant: Carling Technologies, Inc., Plainville, CT (US)

(72) Inventor: Adam Charles Lydecker, Burlington, CT (US)

(73) Assignee: Carling Technologies, Inc., Plainville, CT (US)

( * ) Notice: Subject to any disclaimer, the term of this patent is extended or adjusted under 35 U.S.C. 154(b) by 140 days.

(21) Appl. No.: 15/582,088

(22) Filed: Apr. 28, 2017

(65) Prior Publication Data

US 2018/0315561 A1 Nov. 1, 2018

(51) Int. Cl.

| | |
|---|---|
| ***H01H 21/00*** | (2006.01) |
| ***H01H 19/58*** | (2006.01) |
| ***H01H 19/14*** | (2006.01) |
| ***H01H 19/635*** | (2006.01) |
| *H01H 19/63* | (2006.01) |

(52) U.S. Cl.

CPC ..... *H01H 19/585* (2013.01); *H01H 19/14* (2013.01); *H01H 19/6355* (2013.01); *H01H 19/63* (2013.01); *H01H 2201/032* (2013.01); *H01H 2209/078* (2013.01); *H01H 2221/01* (2013.01)

(58) Field of Classification Search

CPC .. H01H 19/585; H01H 19/14; H01H 19/6355; H01H 19/63; H01H 2201/032; H01H 2209/078; H01H 2221/01

USPC ..... 200/11 A

See application file for complete search history.

(56) References Cited

U.S. PATENT DOCUMENTS

| | | | |
|---|---|---|---|
| 2,520,363 | A | 8/1950 | Heidman, Jr. |
| 2,951,138 | A | 8/1960 | Petrino |
| 3,230,321 | A | 1/1966 | McCann et al. |
| 3,377,604 | A | 4/1968 | Forrest |
| 3,467,793 | A | 9/1969 | Schink et al. |
| 4,082,925 | A | 4/1978 | Hufford |
| 4,581,500 | A | 4/1986 | Henderson et al. |
| 5,150,095 | A | 9/1992 | Jones |
| 5,242,642 | A | 9/1993 | Iijima et al. |
| 5,491,311 | A | 2/1996 | Muscat et al. |
| 6,072,128 | A | 6/2000 | Ansorge et al. |
| 6,236,002 | B1 | 5/2001 | Chou |
| 6,927,348 | B1 | 8/2005 | Schmidt et al. |
| 8,076,603 | B2 | 12/2011 | Huang et al. |
| 9,469,420 | B2 | 10/2016 | Stickelmaier et al. |
| 2016/0312882 | A1 | 10/2016 | Heo et al. |

FOREIGN PATENT DOCUMENTS

| | | | |
|---|---|---|---|
| DE | 4126042 | A1 | 2/1993 |

*Primary Examiner* — Anthony R Jimenez

(74) *Attorney, Agent, or Firm* — Forge IP, PLLC

(57) ABSTRACT

A rotary switch with a knob having an axis of rotation and moveable to a plurality of angular positions and an elongated member extending in a longitudinal direction relative to the axis of the knob. A conductive member is positioned near a plurality of angularly displaced traces formed on a Printed Circuit Board. When the knob is rotated, the rotation is translated to longitudinal movement of the conductive member, which contacts at least one trace to close a circuit.

8 Claims, 8 Drawing Sheets

ROTARY SWITCH EMPLOYING KEYPAD OR SIMILAR MECHANISM FOR POSITION INDICATION

FIELD OF THE INVENTION

The invention is directed toward a rotary switch mechanism, and more specifically, to a rotary switch that includes an axially displaceable member to form a contact with a trace based on the angular position of the switch.

BACKGROUND OF THE INVENTION

Rotary or rotational switches have been known and used for many decades and are known to include multiple connections points.

For example, a well-known type of rotary switch is a slide-type switch. Slide type switches include a conductive member that is rotated into various positions to close contact points where the conductive member contacts. In effect, these are mechanical contacts rotating against traces on, for example, a Printed Circuit Board (PCB). A major drawback of slide-type switches is that as the conductive member is slid, wear occurs due to the physical resistance of the conductive member against the rotational surface. This also has a tendency to cause wear to the contact points as well as the conductive member. In time, the connection between the conductive surface and the various contact points becomes attenuated and inconsistent. This leads to failure of the switch due to the lack of or the relatively poor electrical contact created.

Other types of rotary switches include Hall Effect sensors. These comprise a magnetic component(s) positioned as different angular locations about the rotatory switch, such that, when a magnetic component is rotated to a particular angular location, the device can read the magnetic component and interpret the angular position. These types of switches are non-contact type switches and therefore do not suffer from the wear problems associated with slide-type mechanical switches and therefore have very high reliability and life cycles. However, a major drawback of Hall Effect switches is that they are vulnerable to debris. Likewise, for a rotary switch that is able to determine multiple angular positions, a Hall Effect sensor is required for each angular position. This greatly increased the cost, the complexity and the size of the switch.

Still another type of rotary switch uses a Photo-interrupter sensors to determine angular position. These devices basically determine angular position by reading the outputs of various photo-interrupter sensors that are angularly displaced relative to each other such that, as the rotary switch is turned, the device can determine the position of the knob. These types of sensors, like the Hall Effect sensors, are a non-contact type of sensing device, which greatly increases the life cycle of the switch as they do not suffer from wear related issues. However, a major drawback of Photo-interrupter sensors is that, like Hall Effect sensors, they are vulnerable to debris. They are also very vulnerable to dust, which can obscure the light signals. Also, they too need to have Photo-interrupter sensors at each angular location that needs to be sensed, which increases the cost, complexity and size of the switch.

U.S. Pat. No. 6,236,002 (the '002 patent) outlines another approach has been to position protrusions on a cam that is rotatable and engages with various mechanical contacts that, upon rotation, will interact with the mechanical contact to cause it to form an electrical connection. Unfortunately, the structure of the '002 patent is rather complicated and requires a lot of space. For example, the mechanical contacts must be positioned radially offset from each other so as to be able to be actuated by the various protrusions at differing angular positions. Likewise, the mechanical contacts are subject to wear as they are physically moved based on the interaction of the protrusion with the mechanical contact. This physical interaction as the protrusion slides across the surface of the mechanical contact, will cause the mechanical contact to wear and fail.

U.S. Pat. No. 6,072,128 (the '128 patent) outlines still another approach where rotational movement of the rotary switch translates into linear movement of "contact bridges." While the '128 patent does allow for reduced wear as it eliminates the sliding action of many prior art devices, the construction of the switch is large, complex and bulky. For example, the '128 patent comprises a body 3 that is inserted into a base 2 forming a device that has longitudinally extending channels. In these channels are linearly displaceable contact bridges and springs, which require longitudinal space. While the '128 patent may be useable in locations where space is prevalent, the longitudinally stacked components and complex construction make this switch configuration undesirable.

A need exists therefore, for a rotary switch that is simple in design, is small in depth, and does not suffer from the limitations and drawbacks outlined in connection with the prior art devices discussed above.

SUMMARY OF THE INVENTION

Accordingly, it is desired to provide a rotary switch that is not subject to the wear commonly associated with mechanical switches and is not subject to lower reliability due to debris and dust entering the switch.

It is further desired to provide a rotary switch that having a relatively shallow depth that utilizes a PCB and has a very high life cycle.

It is still further desired to provide a rotary switch that provides a highly reliable connection to a PCB with relatively few moving parts and has a very high life cycle.

These and other objects are achieved in one configuration where a rotary switch is provided with a plurality of contacts that are angularly offset from each other such that upon rotation of the switch about an axis, electrical closure occurs between at least one set of the plurality of contacts. The configuration includes a conductive member that is longitudinally displaceable relative to the axis such that, upon rotation of a knob, the conductive member will displace longitudinally in response to the angular movement thereby causing the closure of at least one of the plurality of contacts.

In another configuration a rotary switch is provided with a PCB that includes a plurality of traces that are angularly offset relatively to each other, a conductive resilient member formed as an angular piece and positioned over the plurality of traces. The rotary switch may include a knob that may be rotated to various angular positions about an axis. An elongated member that extends longitudinally with respect to the axis is coupled to the knob at a proximal end and includes a wheel attached to a distal end. The wheel rides on top of the conductive member and causes the conductive member to be displaced or stretched toward the plurality of traces, such that, the conductive member physically touches the traces in the area of where the wheel contacts the conductive member. In this manner, as the knob is rotated the wheel is also angularly moved such that the conductive member is allowed to resiliently take its former shape, which acts to break the electrical connection with the trace. As the wheel continues to move in an angular direction, the conductive member is progressively deflected downward such that a different trace will be contacted to form an electrical connection.

In still a different configuration, a rotary switch is provided including a plurality of angularly offset traces that, upon rotation of a knob about an axis, will cause an elongated member to be displaced longitudinally with respect to the axis. The knob is provided with a notch or cavity positioned on a surface facing the elongated member such that, when the notch or cavity is angularly aligned with a proximal end of the elongated member, the elongated member moves upward into the notch or cavity. A conductive member is positioned at a distal end of the elongated member and the upward movement of the elongated member allows the conductive member to deflect upwards and away from the set of contacts to an open position. The conductive member is positioned on the underside of a dome or button that is resilient such that when no external force is pressing downward on the top of the dome or button, it will deflect upwards. When the rotary switch is again moved in an angular direction, the notch or cavity is again angularly rotated and the elongated member that was seated within the notch or cavity is again forced downward contacting the top of the dome or button, which in turn forces the conductive member downward to close the set of contacts it is associated with.

It should be understood that the plurality of contacts or traces may be positioned on a Printed Circuit Board in an angular pattern. In one configuration the angular pattern extends at least 90 degrees, while in another configuration the angular pattern extends at least 180 degrees, and in still another 360 degrees. It will be understood by one of skill in the art that any angular pattern can be used depending upon the application and the desired number of positions.

It will be noted that the conductive member comprises a flexible material that is resilient in nature. In the configuration where a wheel is provided at a distal end of the elongated member, the conductive member overlays the plurality of contacts or traces. The wheel acts against an upper surface of the conductive member to flex it downward toward the contact or trace on the PCB. The wheel may further be moved angularly by rotation of the knob. As the wheel moves, the area that was formerly deflected by the application of the wheel on the upper surface, is allowed to return to its previous shape. This effectively means the conductive member moves in a longitudinal direction relative to the axis of rotation of the knob, upwards toward the knob such that the connection between the conductive member and the contact or trace is broken. The conductive member may comprise, for example, a conductive silicone (carbon molded into silicone for conductivity).

In one configuration where the plurality of contacts or traces is formed in a 360 degree pattern, the conductive member is formed as a ring. The upper surface is generally provided as a flat surface, however the bottom surface is provided with an angular channel with an inner shoulder and an outer shoulder. The wheel runs against the upper surface in an angular location corresponding to the channel.

In still another configuration, the plurality of contacts or traces may be positioned on a PCB where an additional contact in the shape of a ring extends around and is radially offset from the plurality of contacts. For example, the additional contact may be radially offset outward from the plurality of contacts with respect to the axis such that the additional contact surrounds the plurality of contacts.

In the configuration where a flexible resilient conductive member is used, it is further contemplated that two elongated members each having a proximal end extending in the longitudinal direction relative to the axis may be used. In this instance, each will have a wheel positioned at a distal end, where each wheel contacts an uppers surface of the conductive member to deflect it downward to contact a contact or trace. In this manner a closed circuit may be established between to the two contacts or traces that are contacted by the conductive member as electrical current can travel from one of the contacts or traces, through the conductive member and to the other contact or trace.

Alternatively, in the single elongated member configuration, when a single contact or trace is contacted by the conductive member, an electrical connection may be formed between the contact or trace and the radially offset additional contact.

It is further contemplated that haptics can be provided in connection with the rotary switch to provide tactile feedback to the user so that they know when the rotary switch is aligned with a particular contact. In addition to tactile feedback indicating angular position over a contact or trace, audible feedback could also be provided as an indication of angular position.

The various configurations described above provide numerous advantages over known systems. For example, Hall Effect sensors or Photo interrupter sensors for position-indication, provide a configuration that does not wear like slide type trace systems, these systems are relatively high cost configurations. Likewise, these systems are subject to dust and debris impeding the correct functioning and operation. As such, they are not suitable for a dusty or harsh environment. Dust can negatively affect the operation of Photo interrupter sensors. Additionally, electrically "noisy" environments, such as where relatively large inductive loads are present, can negatively affect the operation of Hall Effect sensors.

While slide type rotary contacts or traces are relatively low cost and function in dusty and noisy environment, the problem with these types of switches is the mechanical wearing that occurs due to the physical sliding of the conductive member over the contact or trace. This in turn, greatly reduces the life cycle of the slide type switch. As the switch wears, the electrical contact made between the conductive member and the contact or trace becomes increasingly attenuated, which in turn leads to increased resistance resulting in heating and eventual arching. This functions to only increase the catastrophic failure of the slide type rotary switch.

For this application the following terms and definitions shall apply:

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one configuration a rotary switch is provided comprising a plurality of contacts, and a knob having an axis of rotation and moveable to a plurality of angular positions. The rotary switch further comprises an elongated member having a proximal end and extending in a longitudinal direction relative to the axis of the knob, and a conductive member moveable in the longitudinal direction. The rotary switch is provided with the elongated member having a distal end adjacent to the conductive member. The rotary switch is provided such that angular movement of said knob translates to longitudinal displacement of the conductive member to contact as least one of the plurality of contacts.

In another configuration a rotary switch is provided comprising a plurality of traces formed in an angular pattern relative to each other on a Printed Circuit Board and a knob having an axis of rotation and moveable to a plurality of angular positions. The rotary switch further comprises an elongated member having a proximal end and extending in a longitudinal direction relative to the axis of the knob, and a conductive member moveable in the longitudinal direction relative to the axis of the knob. The rotary switch is provided with the elongated member having a distal end adjacent to the conductive member. The rotary switch is provided such that angular movement of the knob translates to longitudinal displacement of the conductive member to contact as least one of the plurality of traces.

Other objects of the invention and its particular features and advantages will become more apparent from consideration of the following drawings and accompanying detailed description.

DETAILED DESCRIPTION OF THE INVENTION

Figure 1:
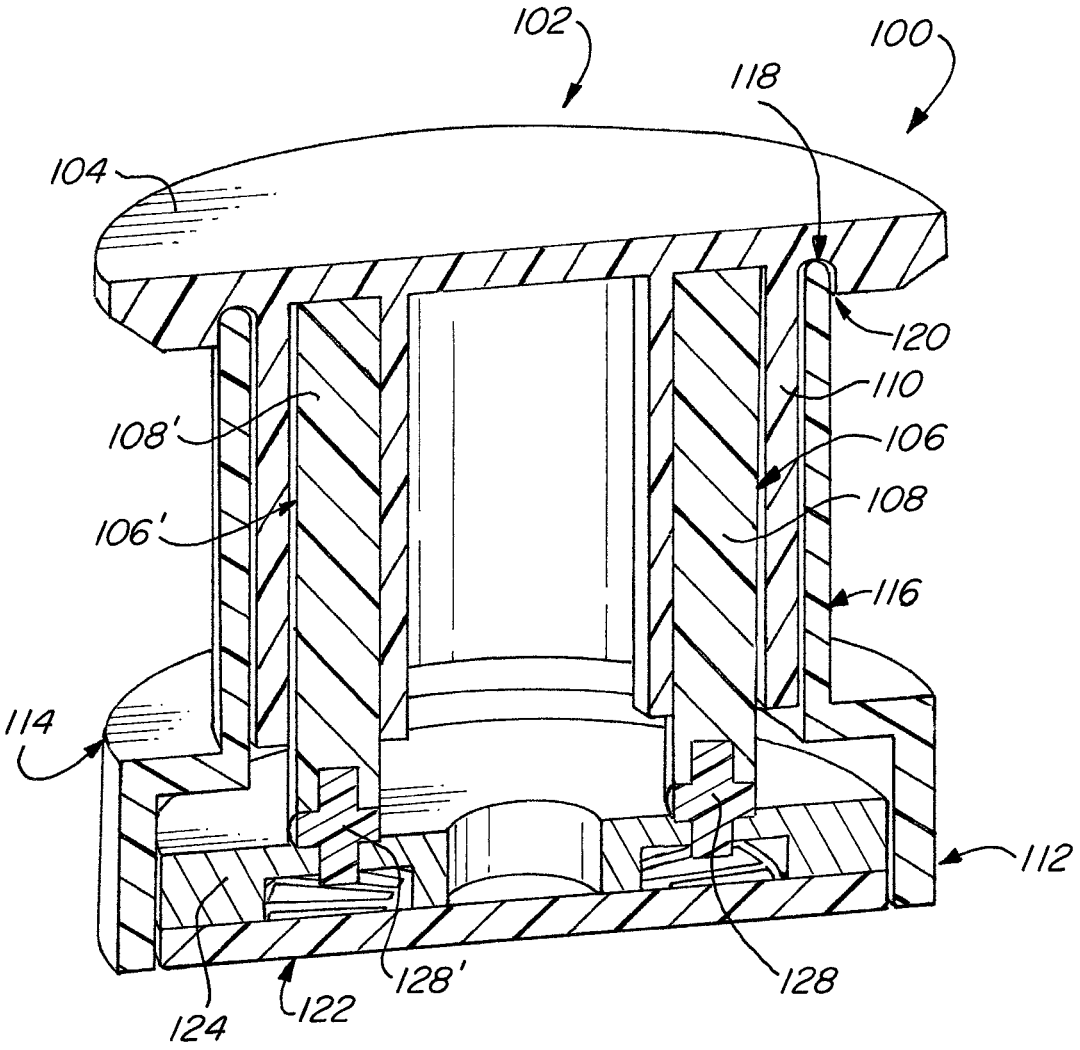
FIG. 1 is a cut away view of one configuration of the rotary switch.

Referring now to the drawings, wherein like reference numerals designate corresponding structure throughout the views.

FIG. 1 comprises a cut away view of a rotary switch 100. Rotary switch 100 includes a knob 102 that comprises an upper portion 104 that may be grasped and rotated. The knob 102 also includes two channels 106, 106' within which two elongated members 108, 108' are positioned. The knob 102 also comprises a side wall 110, which is better illustrated in FIG. 5, which is formed as a cylinder. The two channels 106, 106' are formed on an inside surface of the side wall 110.

Figure 5:
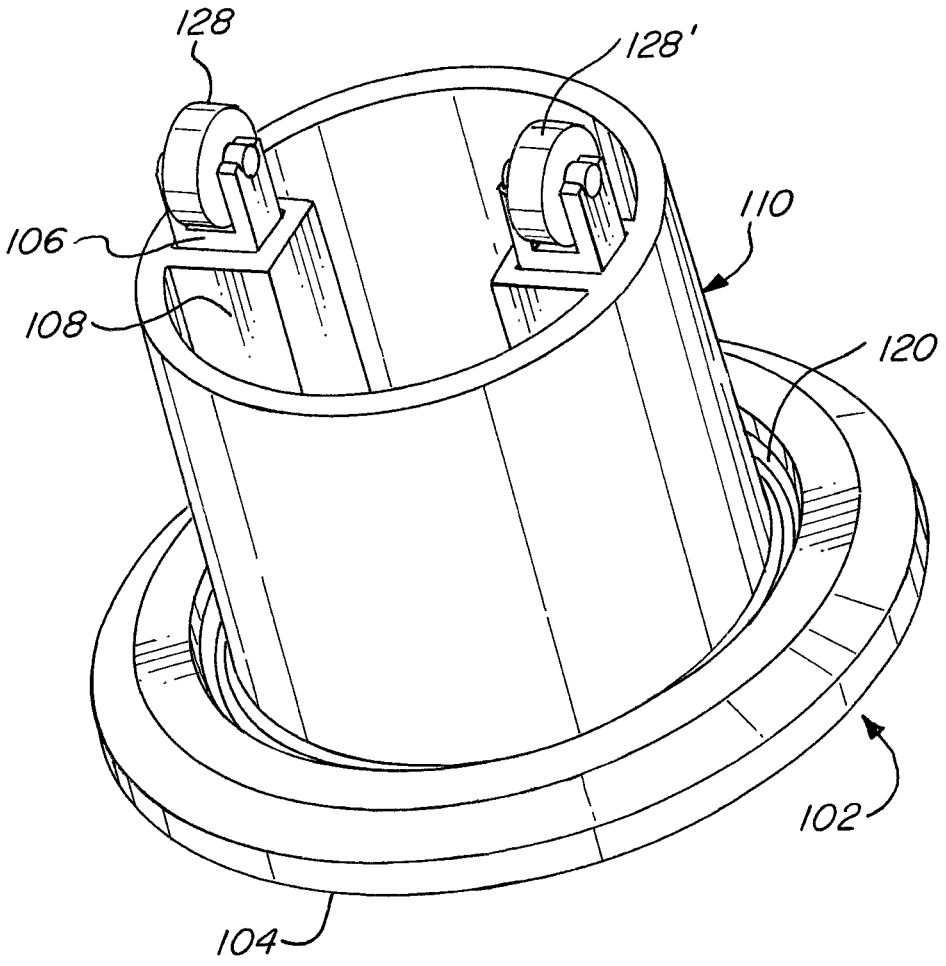
FIG. 5 is a perspective view showing two elongated members, each having wheels positioned at distal ends according to FIG. 1.

Also illustrated in FIG. 1 is base 112, which comprises a circular lower portion 114 and a cylindrical upper portion 116. As can be seen with reference to FIG. 1, the side wall 110 is provided with an outer circumference that allows it to fit inside of cylindrical upper portion 116 of base 112. In practice the inner diameter of cylindrical upper portion 116 will be selected to be just a little larger than the outer circumference of side wall 110. This will allow side wall 110 to rotate freely within cylindrical upper portion 116. It can also be seen that an upper end 118 of cylindrical upper portion 116 is provided to fit within an angular groove 120 of knob 102 (FIG. 5). It is contemplated that, while knob 102 may freely rotate relative to base 112, that knob 102 may be mechanically held to base 112 such that axial movement is prevented. The mechanism for holding the parts together can comprise any method known in the art, including for example, an annular undercut and a protrusion engaging with the undercut (FIG. 5).

Also shown in FIG. 1 is a Printed Circuit Board (PCB) 122 that is coupled to base 112. The PCB 122 will be discussed further in connection with FIG. 3. It is contemplated that PCB 122 can be coupled to or affixed to base 112 by any commonly known method including, for example, friction fit, screws or fasteners, a mechanical fit where the PCB 122 engages with protrusions or channels in the base, or any other appropriate method.

A flexible conductive member 124 is placed on top of the PCB 122. The conductive member 124 can be better seen with reference to FIG. 4. The conductive member 124 is provided with a relatively flat upper surface 126.

Finally, two wheels 128, 128' are positioned, one at the distal end of each of the two elongated members 108, 108'. The two wheels 128, 128' are positioned so that they engage with upper surface 126 of conductive member 124.

Figure 2:
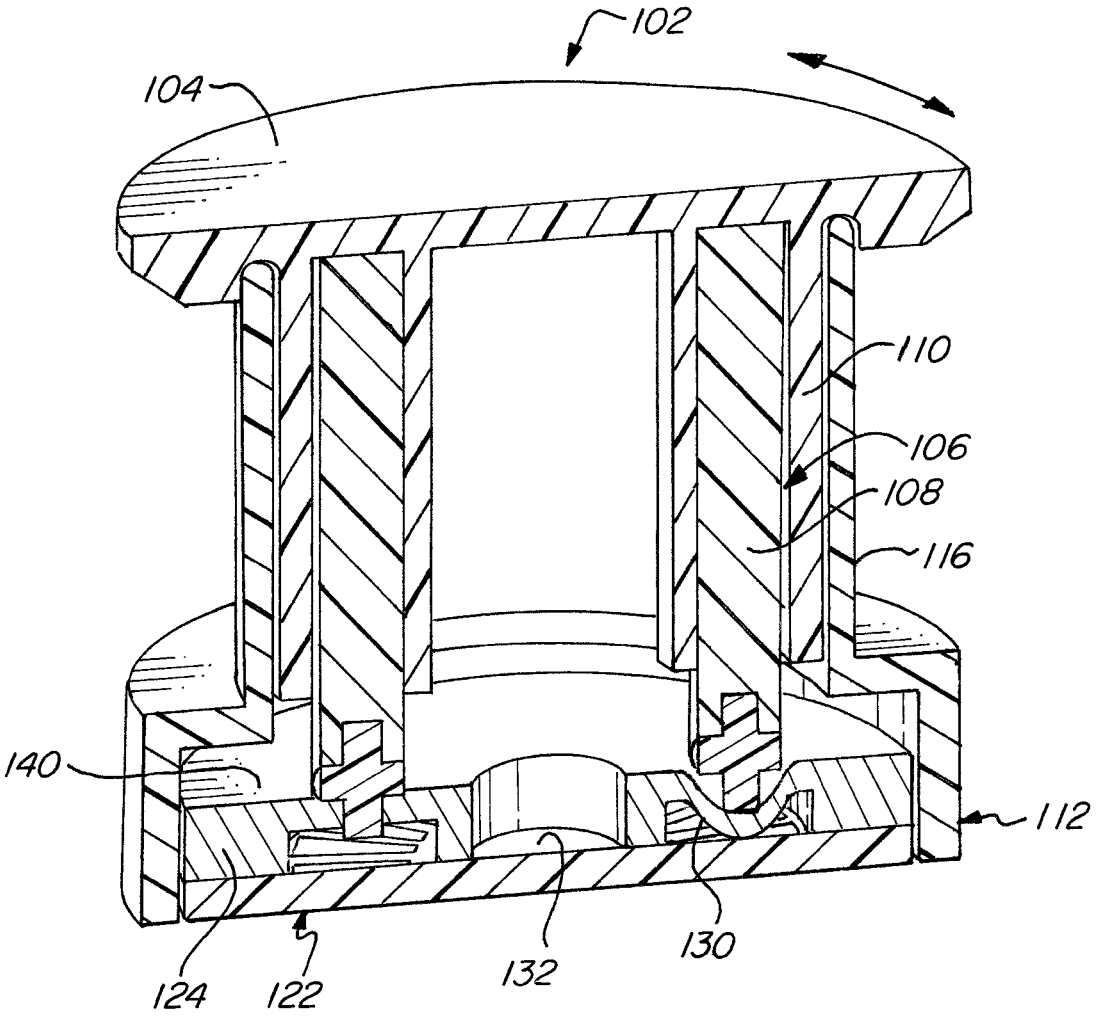
FIG. 2 is a cut away view of the configuration according to FIG. 1 where the conductive member is displaced downward toward a contact or trace.

With reference to FIG. 2, the conductive member 124 is illustrated deflecting in a longitudinal direction relative to an axis of rotation (illustrated by arrows) of knob 102. As the wheel 128 engages with the upper surface 126 of conductive member 124, this causes the conductive member 124 to flex or be pushed downward toward PCB 122. This downward or longitudinal flexing causes a bottom surface 130 of conductive member 124 to contact the surface of the PCB 122. From an operational standpoint, it can be seen that, as the knob 102 is angularly displaced (rotated) the wheels 128, 128' will also rotate relative to the conductive member 124. This will result in conductive member 124 being pushed downward at various angular locations depending upon the angular position of knob 102.

Figure 3:
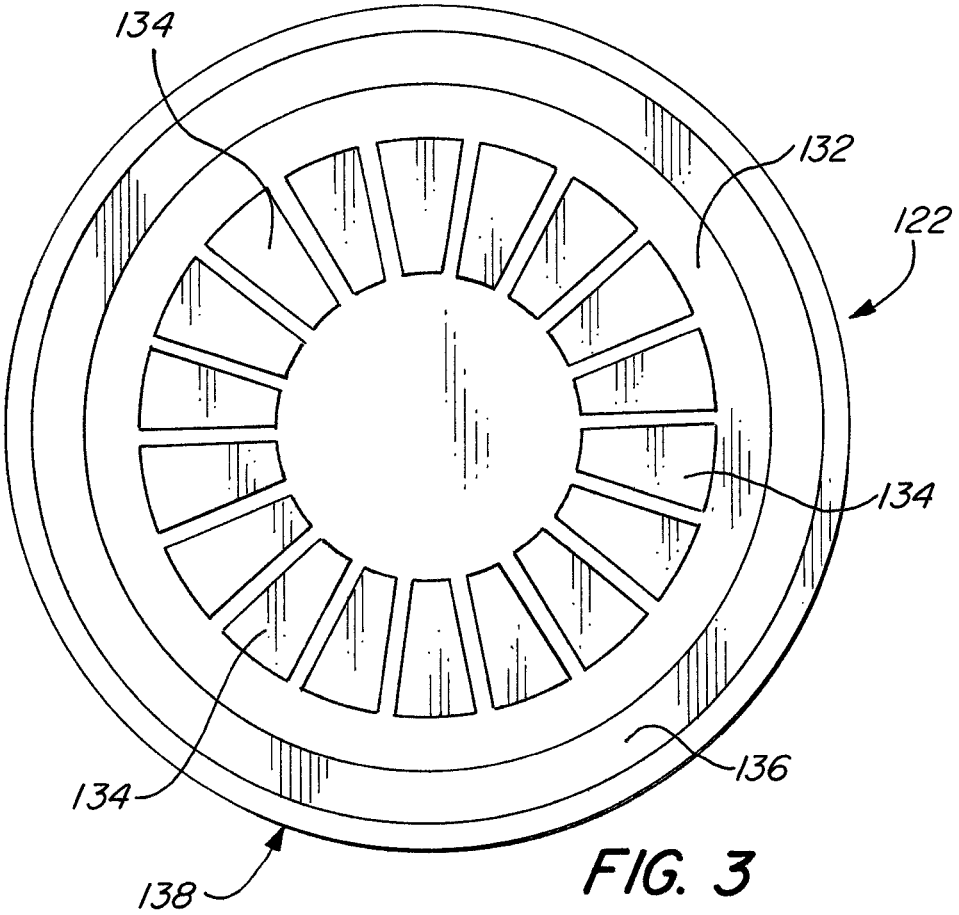
FIG. 3 is top view of a plurality of contacts according to FIG. 1

Turning now to FIG. 3, PCB 122 is illustrated as a flat circular shape. An upper surface 132 is provided having a plurality of contacts or traces 134 positioned thereon. In FIG. 3 a total of 18 different contacts or traces 134 are illustrated, however, it will be understood that any number may be used depending upon the application. Likewise, while the concept of the contacts or traces 134 being angularly offset from each to form 360 degrees of rotation for switch 100, it is contemplated that contacts or traces 134 could be formed at an angle less than 360 degrees, including, for example, 90 degrees or 180 degrees. Again, the configuration can vary depending upon the application.

Also illustrated in FIG. 3 is contact or trace 136. Contact or trace 136 is illustrated in the shape of a ring and radially offset from contacts or traces 134. In FIG. 3, contact or trace 136 is provided near the outside edge 138 of PCB 122 such that contacts or traces 134 are all radially maintained within contact or trace 136.

Figure 4:
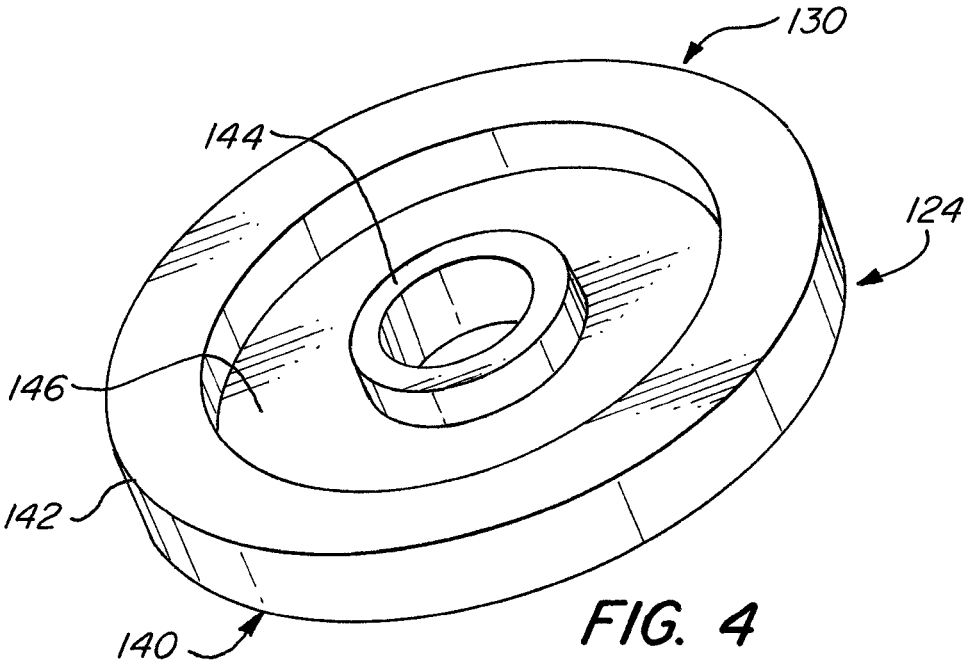
FIG. 4 is a perspective view showing the bottom surface of the conductive member.

FIG. 4 illustrates the underside (the side facing PCB 122) of conductive member 124. As can be seen, the conductive member 124 is formed as a ring. The upper surface 140 is generally flat in construction. The bottom surface 130, however, is provided with an annular shoulder 142 that provides a raised portion around a perimeter of the bottom surface 130. Additionally, an inner shoulder 144 is provided such that, a recess 146 is defined between the annular shoulder 142 and the inner shoulder 144. The conductive member is placed with the recess 146 overlaying the plurality of contacts or traces 134.

The conductive member 124 is provided as a flexible resilient member that can deform and return to its original shape. In one configuration, conductive member 124 comprises conductive silicone (carbon molded into silicone for conductivity). Conductive member 124 may also be provided with conductive regions corresponding to the bottom surface 130. In one instance, annular shoulder 142 and recess 146 define the conductive regions.

When the conductive member 124 is overlaid on PCB 122, the annular shoulder 142 will directly rest on contact or trace 136. The conductive material forming recess 146 will only come in contact with contacts or traces 134 if the material is displaced due to wheel 128, 128'. In this way, different circuits are closed depending on the angular position of the knob 102.

Figure 6:
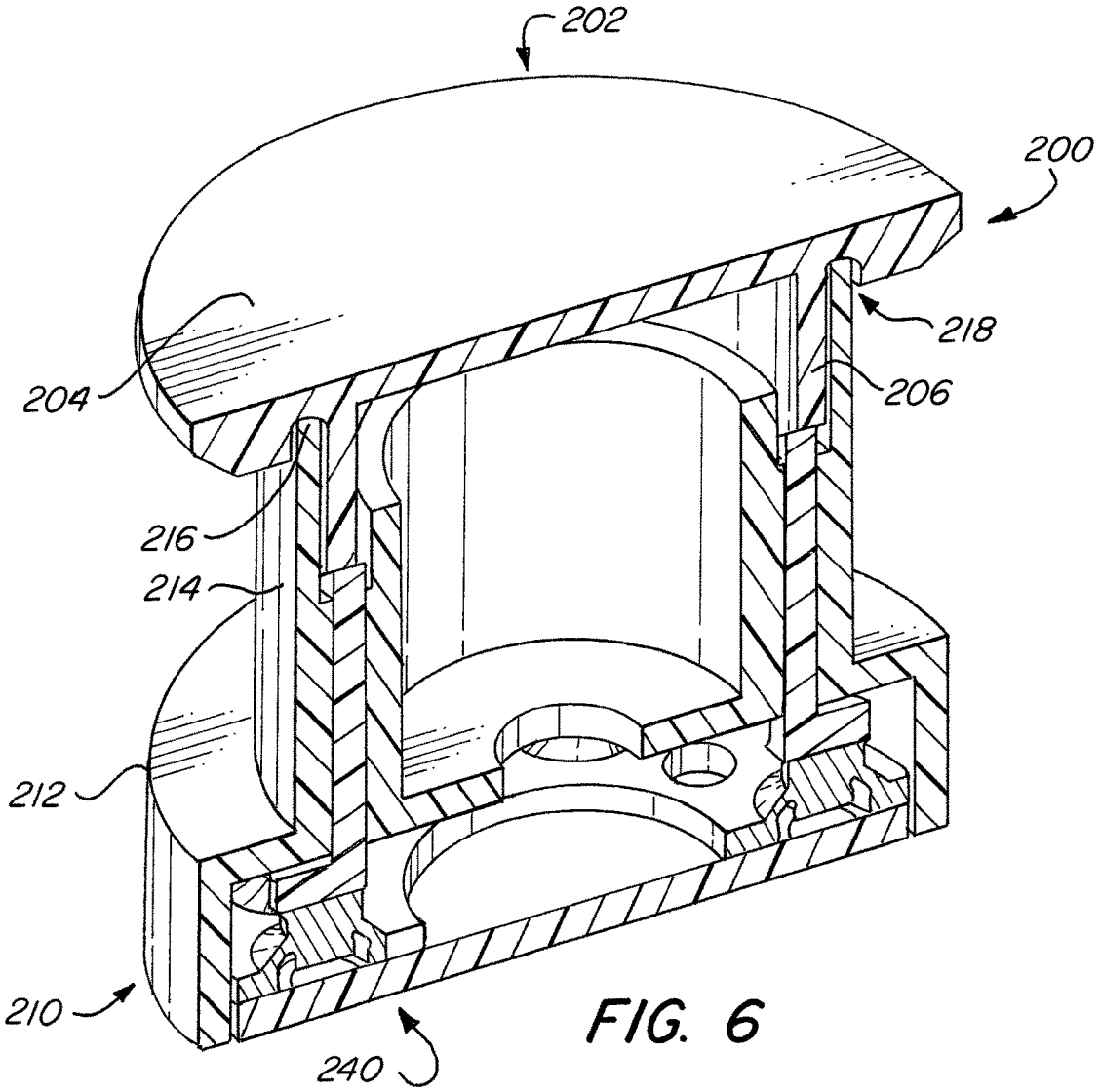
FIG. 6 is a cut away view of one configuration of the rotary switch.

Turning now to FIG. 6, an alternative configuration is shown as rotary switch 200. Rotary switch 200 includes a knob 202 that comprises an upper portion 204 that may be grasped and rotated. The knob 202 also comprises a side wall 206, which is better illustrated in FIG. 8, which is formed as a cylinder. A notch or cavity 208 is form on a lower end side wall 206.

Figure 7:
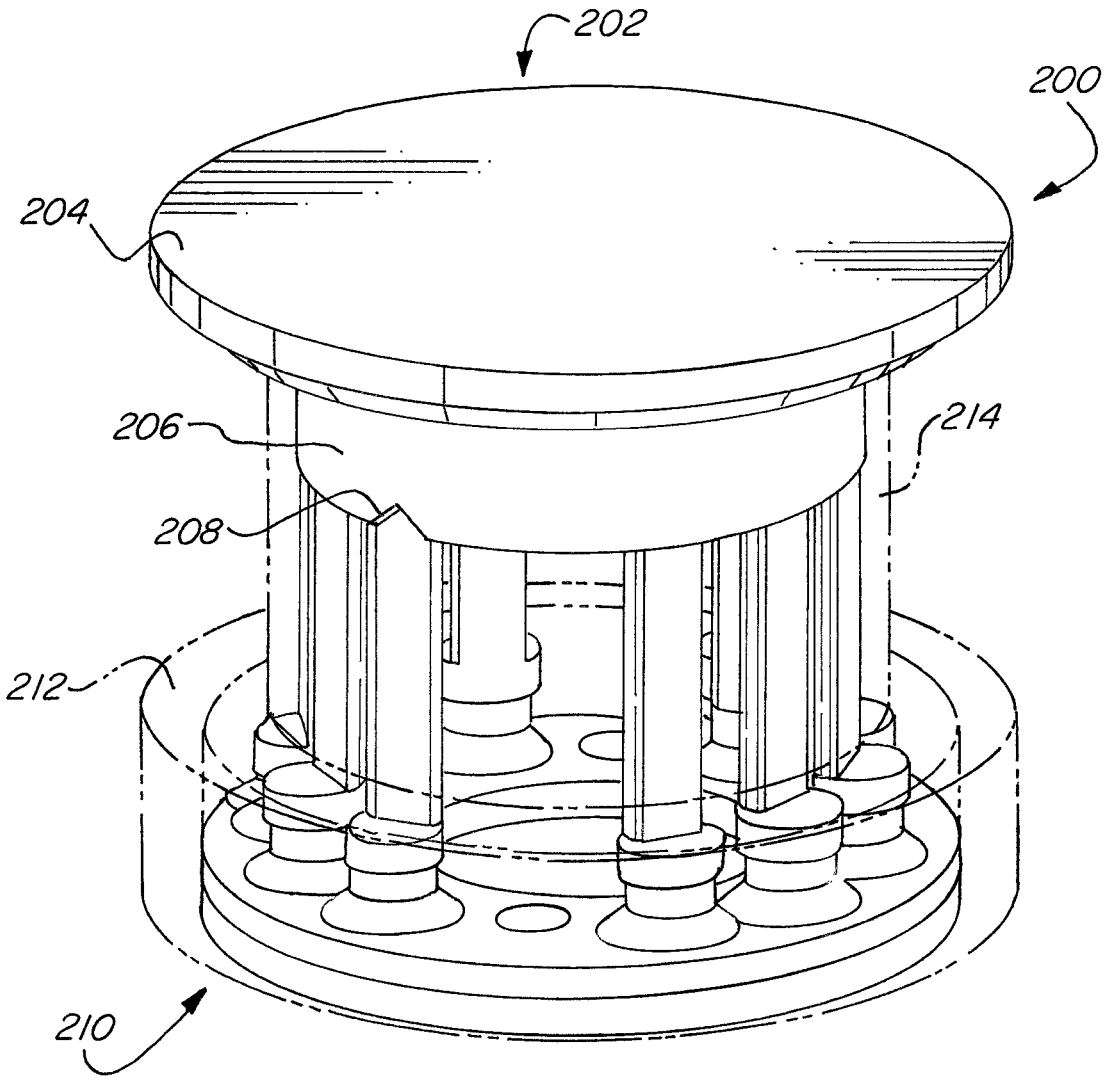
FIG. 7 is an interior view of the configuration according to FIG. 6 where the conductive member is displaced downward toward a contact or trace.

Also illustrated in FIGS. 6 and 7 is base 210, which comprises a circular lower portion 212 and a cylindrical upper portion 214. As can be seen with reference to FIG. 6, the side wall 206 is provided with an outer circumference that allows it to fit inside of cylindrical upper portion 214 of base 210. In practice the inner diameter of cylindrical upper portion 214 will be selected to be just a little larger than the outer circumference of side wall 206. This will allow side wall 206 to rotate freely within cylindrical upper portion 214. It can also be seen that an upper end 216 of cylindrical upper portion 214 is provided to fit within a groove 218 of knob 202 (FIG. 6). It is contemplated that, while knob 202 may freely rotate relative to base 210, that knob 202 may be mechanically held to base 210 such that axial movement is prevented. The mechanism for holding the parts together can comprise any method known in the art, including for example, an annular undercut and a protrusion engaging with the undercut (FIG. 6).

Figure 8:
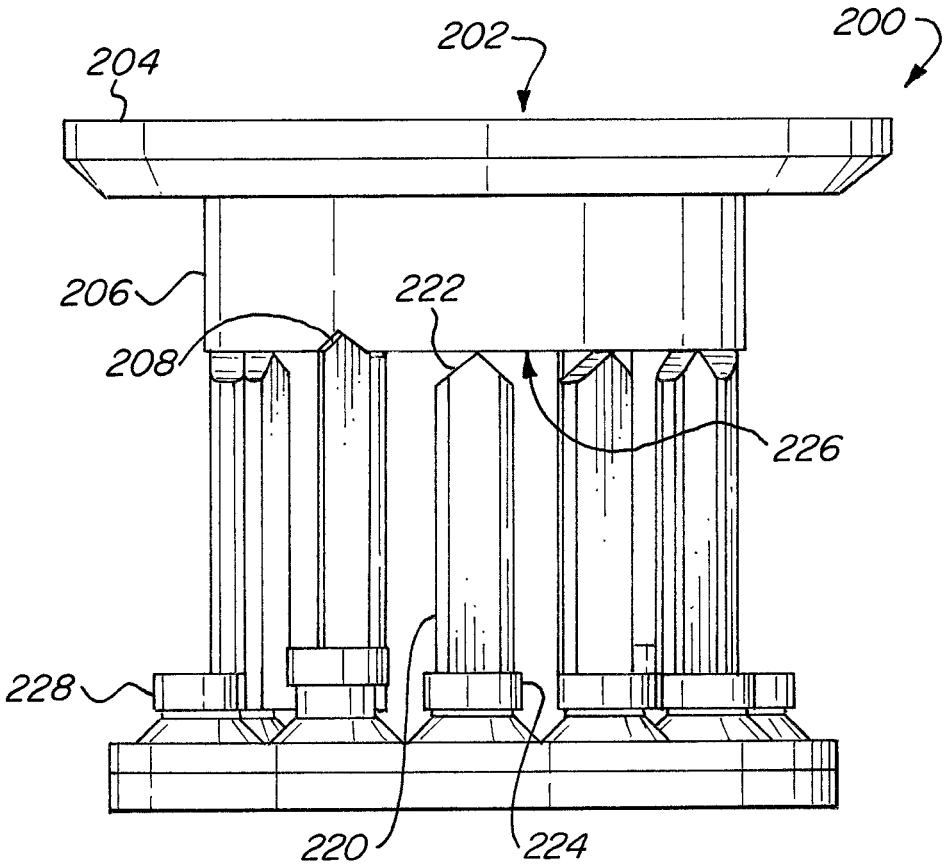
FIG. 8 is a side view of the configuration according to FIG. 7.

Referring now to FIG. 8, elongated members 220 are provided having a first end 222 and a second end 224. As can be seen with reference to FIG. 8, the first end 222 is provided with a tapered end that sits against an end 226 of side wall 206. As is better seen in FIG. 6, elongated members 220 are positioned and held in place by base 210 while at the same time are allowed to move longitudinally.

Figure 9:
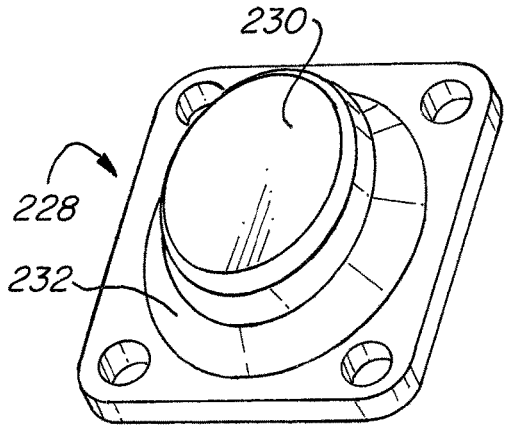
FIG. 9 is a perspective view showing potential configurations of buttons or domes that may be used to hold a conductive member according to FIG. 8.

Second end 224 abuts dome or button 228, which may comprise a relatively flat upper surface 230 (FIG. 9). With reference to FIGS. 9 through 13, it can be seen that dome or button 228 also includes a deflectable portion 232 such that, when the second end 224 presses downward on upper surface 230, the deflectable portion 232 allows the dome or button 228 to be pressed downward. As can be seen a top view (FIG. 9) and a bottom view (FIG. 10) of the dome or button 228 is illustrated. It is contemplated that a conductive member 234 may be positioned on an underside 236 of flat upper surface 230. When the dome or button 228 is depressed fully, the conductive member 234 comes in contact with a set of contacts or traces 238 (FIG. 13), which functions to close the set of contacts or traces 238.

Figure 10:
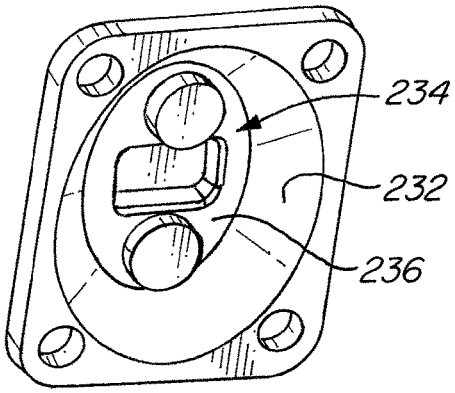
FIG. 10 is a bottom view according to FIG. 9.
Figure 11:
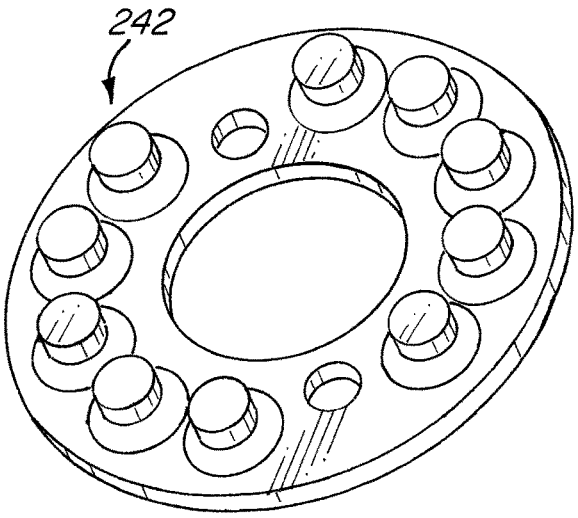
FIG. 11 is a perspective view of a plurality of contacts that are angularly offset from each other according to FIG. 8.
Figure 12:
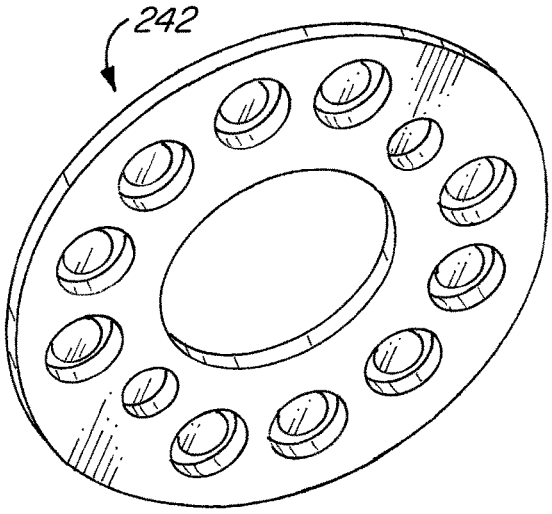
FIG. 12 is a bottom view according to FIG. 11.
Figure 13:
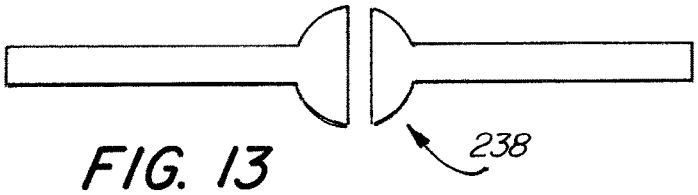
FIG. 13 is a top view of a set of contacts or traces over which a conductive member may be positioned according to FIG. 8.

The dome or button 228 may be provided individually, as shown in FIGS. 9 and 10, or may be provided as a unitary structure as illustrated in FIGS. 11 and 12.

As shown in FIGS. 11 and 12, a plurality of domes or button may be formed into a ring structure and termed a keypad 242 that can be placed over the various contacts or traces 238 that may be positioned on a PCB 240 affixed or attached to base 210.

In operation, the knob 202, when rotated, actuates the elongated members 220 (pins) downward when they are not aligned with the notch or cavity 208. The elongated members 220 (pins) are guided by the base 210 (housing) and actuate individual dome or button 228 on the keypad 242.

When an individual dome or button 228 is depressed, this functions to close a set of contacts or traces 238, which in turn closes a circuit on the PCB 240 when the conductive member 234 touches its associated contact or trace 238 on PCB 240.

The conductive member 234 may comprise a conductive region formed as a structure molded into the underside 236 of flat upper surface 230, or it could comprise a conductive membrane.

In one configuration, keypad 242, may comprise a silicone with a carbon structure molded in as the conductive regions. Alternatively, it could comprise a multi-piece assembly. As a further alternative, it is contemplated that elongated members 220 (pins) could be provided with a conductive bottom.

The domes or buttons 228 provide a spring-force in this design by means of deflectable portion 232.

As an alternative, to the conductive regions, inserts such as molded metal pieces could be used to close the contacts or traces 238.

It is still further contemplated that the rotary switches 100, 200 may be provided with haptics to indicated position to the user. Some methods that could effectively be used include: flexible plastic against grooved surfaces, or springs and plungers (ball bearings) in tubes, with the ball bearing riding on a grooved surface to compress the spring (e.g., the grooved surface could be associated with the base or the knob).

Referring to FIGS. 6 and 8, a notch or cavity 208 in the knob 202 in this assembly allows the elongated members 220 (pin) to move up. In one configuration, there are symmetrical pins and grooves positioned 180 degrees about the axis of the knob 202 for optimal haptics. However, it will be understood that symmetry is an optional feature.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A rotary switch comprising:

a plurality of contacts;

a knob having an axis of rotation and moveable to a plurality of angular positions;

a plurality of elongated members, each having a proximal end and extending in a longitudinal direction generally parallel to the axis of said knob;

a plurality of conductive members, each moveable in the longitudinal direction;

each of said plurality of elongated members having a distal end adjacent to one of said plurality of conductive members;

wherein angular movement of said knob translates to longitudinal displacement of said plurality of conductive members; wherein each of the plurality of conductive members comprises a resilient member which urges a corresponding conductive member away from a corresponding set of contacts;

wherein said knob comprises a side wall having a lower end;

wherein the proximal end of each of said plurality of elongated members comprises a tapered end, a plurality of which sit against the lower end of the side wall of said knob so that a plurality of elongated members cause a plurality of conductive members to be in contact with the plurality of contacts;

wherein the lower end of the side wall of said knob includes a cavity at an angular position, the cavity having a shape corresponding to a shape of the tapered ends of the plurality of elongated members;

wherein one of the plurality of elongated members is longitudinally displaced when said knob is rotated to an angular position corresponding to the one of the plurality of elongated members; and wherein the conductive member associated with the longitudinally displaced elongated member is urged out of contact with a corresponding contact by the corresponding resilient member while simultaneously the cooperation of the tapered end of the longitudinally displaced elongated member with the correspondingly shaped cavity in the lower end of the side wall of said knob causes the tapered end of the longitudinally displaced elongated member to seat within the correspondingly shaped cavity in the lower end of the side wall of said knob so as to provide haptic feedback for a user indicative of said knob being in a specific rotational position.

2. The rotary switch according to claim 1 further comprising a base within which said knob is positioned, wherein said knob is rotatable relative to said base.

3. The rotary switch according to claim 1 wherein said plurality of contacts are positioned on a printed circuit board.

4. The rotary switch according to claim 1 wherein said plurality of contacts are angularly offset from each other.

5. The rotary switch according to claim 1 wherein said plurality of contacts form an angular pattern of at least 90 degrees.

6. A rotary switch comprising:

a plurality of traces formed in an angular pattern relative to each other on a printed circuit board;

a knob having an axis of rotation and moveable to a plurality of angular positions, said knob comprising a side wall having a lower end;

a plurality of elongated members, each having a proximal end and extending in a longitudinal direction generally parallel to the axis of said knob;

a plurality of conductive members, each moveable in the longitudinal direction relative to the axis of said knob and each comprising a resilient member which urges a corresponding conductive member away from a corresponding set of contacts;

each of said plurality of elongated members having a distal end adjacent to one of said plurality of conductive members, and wherein the proximal end of each of said plurality of elongated members comprises a tapered end, a plurality of which sit against the lower end of the side wall of said knob so that a plurality of elongated members cause a plurality of conductive members to be in contact with the plurality of contacts; and wherein angular movement of said knob translates to longitudinal displacement of said plurality of conductive members;

wherein the lower end of the side wall of said knob includes a cavity at an angular position, the cavity having a shape corresponding to a shape of the tapered ends of the plurality of elongated members;

wherein one of the plurality of elongated members is longitudinally displaced when said knob is rotated to an angular position corresponding to the one of the plurality of elongated members; and wherein the conductive member associated with a longitudinally displaced elongated member is urged out of contact with the corresponding contact by the corresponding resilient member while simultaneously the cooperation of the tapered end of the longitudinally displaced elongated member with a correspondingly shaped cavity in the lower end of the side wall of said knob causes the tapered end of the longitudinally displaced elongated member to seat within the correspondingly shaped cavity in the lower end of the side wall of said knob so as to provide haptic feedback for a user indicative of said knob being in a specific rotational position.

7. The rotary switch according to claim 6 further comprising a base within which said knob is positioned, wherein said knob is rotatable relative to said base.

8. The rotary switch according to claim 6 wherein said plurality of traces form an angular pattern of at least 90 degrees.

* * * * *